United States Patent [19]

Koch et al.

[11] Patent Number: 4,608,189

[45] Date of Patent: Aug. 26, 1986

[54] DETERGENTS AND LIQUID CLEANERS FREE OF INORGANIC BUILDERS

[75] Inventors: Karlheinz Koch, Haan; Ingo Wegener; Brigitte Giesen, both of Düsseldorf, all of Fed. Rep. of Germany

[73] Assignee: Henkel Kommanditgesellschaft auf Aktien, Düsseldorf, Fed. Rep. of Germany

[21] Appl. No.: 731,760

[22] Filed: May 8, 1985

Related U.S. Application Data

[63] Continuation-in-part of Ser. No. 512,514, Jul. 11, 1983, abandoned.

[30] Foreign Application Priority Data

Sep. 2, 1982 [DE] Fed. Rep. of Germany ..... 3232616

[51] Int. Cl.[4] ..... C11D 3/075; C11D 9/00; C11D 1/66; C11D 9/22

[52] U.S. Cl. ..... 252/174.22; 252/108; 252/117; 252/118; 252/132; 252/174.12; 252/DIG. 1; 252/DIG. 12; 252/DIG. 14

[58] Field of Search ..... 252/108, 117, 132, 174.22, 252/DIG. 1, DIG. 14, DIG. 12, 174.12, 118

[56] References Cited

U.S. PATENT DOCUMENTS

| | | | |
|---|---|---|---|
| 2,174,761 | 4/1939 | Weidenhaupt | 260/458 |
| 3,022,335 | 2/1962 | Lundsted | 252/DIG. 1 |
| 3,709,838 | 1/1973 | Mausner et al. | 252/DIG. 14 |
| 3,733,281 | 5/1973 | Durfey | 252/118 |
| 3,860,536 | 1/1975 | Landwerlen et al. | 252/551 |
| 4,101,457 | 7/1978 | Place et al. | 252/174.12 |
| 4,111,855 | 9/1978 | Barrat et al. | 252/DIG. 12 |
| 4,115,292 | 9/1978 | Richardson et al. | 252/174.12 |
| 4,176,079 | 11/1979 | Guerry et al. | 252/DIG. 12 |
| 4,272,394 | 6/1981 | Kaneko | 252/174.22 |
| 4,280,919 | 7/1981 | Stoeckigt et al. | 252/135 |
| 4,316,824 | 2/1982 | Pancheri | 252/174.22 |

FOREIGN PATENT DOCUMENTS

| | | | |
|---|---|---|---|
| 2727463 | 5/1978 | Fed. Rep. of Germany | 252/DIG. 12 |
| 2021142 | 11/1979 | United Kingdom | 252/174.12 |

*Primary Examiner*—John E. Kittle
*Assistant Examiner*—Mukund J. Shah
*Attorney, Agent, or Firm*—Ernest G. Szoke; Henry E. Millson, Jr.; Mark A. Greenfield

[57] ABSTRACT

Aqueous liquid laundering and cleaning detergent compositions, essentially free from inorganic builder salts, comprising:

(a) 20–40 wt. % of a mixture of nonionic surfactants of the formula:

$$RO—[CH_2—CH(CH_3)—O]_m—(CH_2—CH_2—O)_n—H \quad (I)$$

where R is a $C_{10}$–$C_{20}$ aliphatic hydrocarbon group; m=1–5; n=3–20; n>m; and the mixture is composed of:

(i) 5–9 parts by weight of a Formula I compound where n=3–9, (ii) 1–5 parts by weight of a Formula I compound where n=10–20, and (iii) 0–6 parts by weight of a Formula I compound where m=1–3, and n=9–11;

(b) 2–25 wt. % of a sodium, potassium, mono-, di- or trialkanolamine soap of a $C_{10}1$–$C_{20}$ fatty acid;

(c) 0.001–2 wt. % of a proteolytic enzyme; and (d) 5–25 wt. % $C_2$14 $C_4$ mono- or polyhydroxy alcohol;

wherein (a) and (b) together are 30–50 wt. % of the composition, and a 1% aqueous solution thereof has a pH of 6.5–9.

10 Claims, No Drawings

DETERGENTS AND LIQUID CLEANERS FREE OF INORGANIC BUILDERS

This application is a continuation-in-part of application Ser. No. 512,514, filed July 11, 1983, now abandoned.

BACKGROUND OF THE INVENTION

German Published Application Nos. 1,975,010; 2,022,064; 2,136,340; 2,152,141; 2,301,728; 2,304,060; 2,304,098, 2,309,463; 2,363,730; 2,431,718; 2,512,616; 2,527,793; 2,559,224; 2,559,225; 2,609,752; 2,646,057; 2,635,913; 2,658,073; 2,709,463; 2,709,476; 2,948,921; European Published Application Nos. 8,142; 19,315; 28,865 and 28,866; French Pat. No. 1,397,399; and U.S. Pat. No. 3,860,536 teach liquid laundry detergents with varying quantities of nonionic surfactants, frequently present in a mixture with soaps and anionic surfactants of the sulfonate or sulfate type. These products are essentially free of inorganic builders such as condensed alkali metal phosphates, silicates and carbonates. They frequently contain enzymes and suitable stabilizers therefor, as well as alkanolamines, especially triethanolamine, and small amounts of polyacids, such as citric acid and polyphosphonic acids. The nonionic surfactants are generally derived from alkylphenols or fatty alcohols or oxo-alcohols of different chain length and display different degrees of alkoxylation depending on their desired effect. Basically, however, the only alkoxylation products which have been disclosed are those whose polyglycol ether residue is made up of ethylene glycol residues, regardless of the degree of alkoxylation. In contrast to these, it is known that polypropylene glycol ether groups do not possess hydrophilic properties, and therefore propoxylated fatty alcohols or alkylphenols are considered unsuitable for use in concentrated aqueous liquid laundry detergents.

German Published Application No. 2,810,703 discloses nonionic surfactants obtained by simultaneous or alternating addition of ethylene oxide and propylene oxide to higher alcohols. In the glycol ether residues in that Application the ethylene and propylene glycol groups are present in random distribution or repeated alternation. Compared to related alkoxylates of the general formulas R—O—X—Y and R—O—Y—X (X=polyethylene glycol group, Y=polypropylene glycol group), these compounds have a lower melting point and should therefore be substantially more suitable for use in liquid laundry detergents and have a higher laundering power toward fatty and mineral soils than the compound types given by the above formulas.

In addition, German Published Application No. 2,724,349 describes spray dried laundry detergents produced using alkoxylates ates of the preceding formula R—O—Y—X. However, there is no teaching of the production of liquid laundry detergents in this publication. The same is true for U.S. Pat. No. 4,280,919 in which the use of such alkoxylation products as low foam, biodegradable surfactants in laundry detergents and cleaning agents is suggested. In addition, U.S. Pat. No. 2,174,761 dated 1939, in which alkoxylates of the type in question were first described, gives no disclosure of liquid laundry detergents which would fulfill the current requirements for stability and laundering properties, the latter having become greatly increased compared to those of the year of publication of this patent.

The liquid laundry detergents based on ethoxylated fatty alcohols described in the first paragraph above have sufficient laundering ability relative to mineral and fat-containing soils and—insofar as they also contain proteases and suitable stabilizing agents for the latter—toward protein-containing stains as well. On the other hand, the laundering ability may not be fully satisfactory in relation to bleachable soils, especially stubborn tea stains. Since oxidizing bleaches are unsuitable in view of their insufficient stability in aqueous preparations and especially their destructive effect toward enzymes, a need exists for a suitable composition which is more effective with respect to colored soils without a decrease in laundering power relative to the other impurities. These characteristics were not to be expected of the compounds of formula R—O—Y—X, since the cited German Published Application No. 2,810,703 teaches that such surfactants have a reduced laundering capacity and are not very suitable for liquid concentrates because of their high melting point.

DESCRIPTION OF THE INVENTION

The present invention relates to homogeneous aqueous liquid laundry detergents and cleaning agents, essentially free of inorganic builder salts, which are compositions containing the following ingredients:

(A) from about 20 to about 40 wt. % of a mixture of nonionic surfactants of Formula I:

$$RO—[CH_2—CH(CH_3)—O]_m—(CH_2CH_2—O)_n—H \quad (I)$$

in which R represents an aliphatic hydrocarbon group which is either linear or methylated in the 2-position, saturated or unsaturated, with 10 to 20 carbon atoms; the subscript m represents a number from 1 to 5; the subscript n represents a number from 3 to 20; with n>m, and the mixture is made up as follows:

(A1) from about 5 to about 9 parts by weight of a compound of Formula I wherein n=3 to 9, (A2) from about 1 to about 5 parts by weight of a compound of Formula I wherein n=10 to 20, and (A3) from 0 to about 6 parts by weight of a compound of Formula I wherein m=1 to 3 and n=9 to 11;

(B) from about 2 to about 25 wt. % saturated and/or mono-unsaturated fatty acid with 10 to 20 carbon atoms, present as a soap of sodium, potassium and/or a mono-, di- or trialkanolamine;

(C) from about 0.001 to about 2 wt. % of a proteolytic enzyme; and (D) from about 5 to about 25 wt. % of at least one monohydroxy and/or polyhydroxy alcohol with 2 to 4 carbon atoms;

wherein the weight of components (A) and (B) together amounts to about 30 to 50 wt. %, preferably about 35 to about 45 wt. %, and the pH value of a 1% aqueous solution of the compositions is in the range of from about 6.5 to about 9.

The compounds of Formula I can be obtained in a known manner by propoxylation of alcohols and subsequent ethoxylation. The propylene glycol ether group content (subscript m) of components A1 and A2 may be the same or different. The mixture of compounds of Formula I preferably has the following composition with respect to the A1 and A2 components:

A1 with m=1 to 3, and n=4 to 8,

A2 with m=1 to 4, and n=12 to 16, wherein for each 6 to 8 parts by weight of A1, 2 to 4 parts by weight of A2 are present.

In compounds of Formula I above, the values of n and m represent statistical averages, due to the fact that the alkoxylation reactions used to prepare the compounds result in mixtures of compounds having different levels of alkoxylation. For example, n=5 means that a mixture of compounds are present wherein the predominant compound has n equal to 5. Other compounds having higher or lower ethoxylation are also present in quantities that decrease, according to a bell-shaped curve, the further away n is from 5, i.e. compounds where n=4 or 6 are present in what are still relatively high amounts; compounds where n=3 or 7 are present in much lesser amounts, and compounds where n=1 or 9 are present in only small amounts.

The compounds of Formula I are derived from saturated and/or mono-unsaturated fatty alcohols of natural origin, such as lauryl, myristyl, cetyl, palmitoleyl, stearyl, oleyl, elaidyl, arachyl and gadoleyl alcohol or from synthetic alcohols, for example oxo-alcohols, wherein the latter usually consist of a mixture of linear alcohols and alcohols branched with methyl in the 2-position. The R group in the mixture of compounds of Formula I above can be a single group or Formula I can represent a mixture of compounds having different R groups coming within the definition therefor given above. Preferably, Formula I represents a mixture of compounds wherein from 25 to 100 wt. % are compounds having monounsaturated R groups and 0 to 75 wt. % are compounds having saturated R groups, and wherein the R groups contain 12 to 18 carbon atoms. Examples of suitable alcohols forming the R groups are mixtures of 30 to 100 wt. %, preferably 40 to 80 wt. %, of oleyl alcohol and 0 to 70 wt. %, preferably 20 to 60 wt. %, of lauryl, myristyl, cetyl and stearyl alcohol, as can be obtained for example from coconut and tallow fatty acids or other natural fatty acid mixtures by hydrogenation.

Component B consists of one or more fatty acids in the form of their alkali metal or alkanolamine soaps, which are saturated or monounsaturated and contain 10 to 20, preferably 12 to 18 carbon atoms. Suitable fatty acids include in particular coconut and tallow fatty acids as well as mixtures of these, which essentially contain lauric, myristic, palmitic, stearic and oleic acids. They are preferably available as sodium and/or triethanolamine soaps, wherein mixtures of 1 to 9 parts by weight of sodium soaps and 9 to 1 parts by weight of triethanolamine soaps are particularly preferred. The fraction of component B in the compositions in accordance with the invention, based on fatty acid, as stated above is from about 2 to about 25 wt. %, and is preferably from about 5 to about 20 wt. %.

The proteolytic enzyme (component C) is preferably a protease or a mixture of a protease and an amylase obtained from bacterial strains. Suitable enzymes include, for examble, those obtained from *Bacillus subtilis, Bacillus licheniformis* and *Streptomyces griseus.* These enzymes generally contain water-soluble calcium salts as potentiating and stabilizing agents and are adjusted to a defined degree of activation by means of standardizing agents, e.g., neutral salts. The quantity of enzyme present is preferably from about 0.01 to about 1 wt. %.

The organic solvent contained in the present composition at a quantity of from about 5 to about 25 wt. % (component D) consists of a monohydric or a polyhydric alcohol or an ether alcohol, such as ethanol, propanol, isopropanol, ethylene glycol, diethylene glycol, 1,2-propylene glycol and glycerine. Mixtures of two or more of such alcohols can also be employed herein. Ethanol, isopropanol and propylene glycol are preferred, and are preferably employed in mixtures, wherein the weight ratio of monohydric alcohol to propylene glycol is in the range of from about 5:1 to about 1:5. The quantity of component D present is preferably from about 8 to about 16 wt. %.

Additional advantageous but optional components include free alkanolamines, especially triethanolamine, which exerts a stabilizing effect on the liquid preparation and especially on the proteolytic enzymes contained therein, and is used in such an amount that, beyond the amount needed to neutralize the acid components present, an excess of from about 0.5 to about 10 wt. %, preferably about 1 to about 5 wt. %, of the alkanolamine is present. Acidic components referred to herein include free (i.e. not bound as alkali salts) fatty acids, polyacids and sulfonic acids, which can be present for example, as optical brighteners, as described below.

Another advantageous but optional component which can added to the compositions of the invention includes from about 0.1 to about 3 wt. % of a polyacid, such as citric acid and polyphosphonic acids. Suitable polyphosphonic acids include, for example, 1-hydroxyethane-1,1-diphosphonic acid, aminotrimethylenephosphonic acid, ethylenediaminetetramethylenephosphonic acid and their higher homologs, such as diethylenetriaminepentamethylenephosphonic acid and 1-aminobutane-1,1-diphosphonic acid.

Additional useful polyacids are phosphonoalkanecarboxylic acids, such as 1-phosphonoethane-1,2-dicarboxylic acid, 2-phosphonopropane-2,3-dicarboxylic acid, 1-phosphonopropane-1,2,3-tricarboxylic acid, 1-phosphonopropane-1,2-dicarboxylic acid, 1-phosphono-2-methylpropane-1,2,3-tricarboxylic acid, 2-phosphonobutane-2,3-dicarboxylic acid, 2-phosphonobutane-2,3,4-tricarboxylic acid, 2-phosphonobutane-1,2,4-tricarboxylic acid, 1-phosphonobutane-1,2,3-tricarboxylic acid, 1-phosphono-2-methylbutane-1,2,3-tricarboxylic acid, 2-phosphono-3-methylbutane-2,3,4-tricarboxylic acid, 2-phosphonopentane-2,3,4-tricarboxylic acid, 2-phosphono-3-methylpentane-2,3,4-tricarboxylic acid, 1,1-diphosphonopropane-2,3-dicarboyxlic acid, 1,1-diphosphono-2-methylpropane-2,3-dicarboxylic acid, 2,2-diphosphonobutane-3,4-dicarboxylic acid, 1,1-diphosphonobutane-2,3-dicarboxylic acid, 2,2-diphosphono-3-methylbutane-3,4-dicarboxylic acid, 2,2-diphosphonopentane-3,4-dicarboxylic acid 1,1-diphosphono-2-methylbutane-2,3-dicarboxylic acid, and 2,3-diphosphono-3-methylpentane-3,4-dicarboxylic acid.

A preferred polycarboxylic acid is citric acid, which is advantageously present in quantities of from about 0.5 to about 3 wt. %. Additional preferred polyacids are aminotrimethylenephosphonic acid and ethylenediamine-tetramethylene phosphonic acid, which may be present in quantities of from about 0.1 to about 3 wt. %.

Other optional components include optical brighteners, for example, those from the class of substituted 4,4-bistriazinyl-diaminostilbene-disulfonic acids or the diphenyldistyryls. 4,4-Bis(2-anilino-4-morpholino-1,3,5-triazinyl-6-amino)-stilbenedisulfonic acid-2,2' and diphenyldistyryldisulfonic acid are preferred. The optical brighteners may be present as salts of sodium, potassium or alkanolamines, wherein the sodium salt is the most common. In general, the amount of optical brighteners present is in the range of from about 0.05 to about 1 wt. %.

Other suitable additives include lower monocarboxylic acids or their salts, which exert an additional stabilizing action on the liquid concentrates or enzymes. Examples include formic acid, acetic acid, glycolic acid and lactic acid. The quantity thereof present in the detergent compositions of the invention, based on free acid, can be up to 2 wt. %, preferably about 0.001 to about 1 wt. %.

Additional optional components include foam inhibitors, especially defoamers from the group of silicones; coloring materials and perfumes; opaquing agents; antimicrobial agents; as well as solubility-enhancing compounds from the class of the alkylbenzene sulfonates with 1 to 3 carbon atoms in the alkyl chains.

The compositions of all components, especially the acidic and alkalizing components, are selected such that the pH value amounts to from about 6.5 to about 9, preferably about 8 to about 8.5, in 1% aqueous solution. The water content of the concentrates averages from about 35 to about 60 wt. %.

The procedure advantageously employed in manufacturing the detergent and cleaning agents of the invention is that of dissolving the soap-forming fatty acids or at least the major portion of these at a temperature above their melting point in an aqueous solution of an alkali metal hydroxide or an alkanolamine, then cooling the solution to temperatures below 50° C. and adding the organic solvents. Next the other components are stirred into the still warm solution. The enzymes are then added into the mixture after it is cooled below 30° C., preferably below 25° C.

The liquid laundry detergents in accordance with the invention are characterized by high storage stability even at low or elevated temperatures. So long as the storage temperature does not substantially exceed 35° C., the enzymes are stable for many months. Their cleaning capacity with respect to fatty, protein-containing and mineral soils is good and corresponds to the performance of known liquid laundry detergents of comparable compositions. However, with respect to these comparison products, the laundering capacity of the detergent compositions of the invention is improved with regard to colored soils, especially tea stains.

The following examples are given to illustrate the invention and not to limit it.

EXAMPLE 1

In a solution of 1.2 parts by weight NaOH in 35 parts by weight of water heated to 70° C. there were dispersed 10 parts by weight of a hydrogenated palm kernel fatty acid consisting of a mixture of saturated fatty acids with 12 to 18 carbon atoms. After addition of 5 parts by weight triethanolamine the solution was cooled to 40° C. and mixed with 10 parts by weight ethanol (96%) and 5 parts by weight 1,2-propylene glycol. Then 30 parts by weight are added of a mixture containing 2.5 parts by weight coconut fatty acid, 2.5 parts water and (A1) 17.4 parts by weight of an alkoxylated fatty alcohol mixture of Formula I with m=1.2 and n=6.3;

(A2) 7.6 parts by weight of an alkoxylated fatty alcohol mixture of Formula I with m=2 and n=14, whose fatty alcohol R groups consist of 60 wt. % oleyl alcohol, 30 wt. % cetyl alcohol and 10 wt. % stearyl alcohol. Following the addition of 0.06 parts by weight of lactic acid and 0.06 parts by weight of an optical brightener of the bis(triazinyl)-aminostilbene-disulfonic acid type the solution was cooled to 20° C. and mixed with 0.78 parts of a proteolytic enzyme obtained from *Bacterium subtilis* strains. The resulting detergent composition contained 38.9 wt. % water and, at a 1% aqueous dilution, had a pH of 8.2. The soap contained in the composition was about 60% in the form of the sodium soap and about 40% as the triethanolamine soap.

The detergent composition was in the form of a clear, slightly viscous solution, which became cloudy without signs of separation when cooled to temperatures below 14° C. When it was reheated to room temperature the cloudiness disappeared again. Storage experiments at 25° C. revealed no decrease in enzyme activity within an observation time of two months.

COMPARISON EXPERIMENTS

In the composition according to EXAMPLE 1, the alkoxylates A1 and A2 were replaced by the following compounds or mixtures as shown below:

V1: 25 parts by weight of 5-fold ethoxylated fatty alcohol ($C_{12}$–$C_{18}$, mean chain length $C_{15.5}$).

V2: 25 parts by weight 12-fold ethoxylated fatty alcohol ($C_{12}$–$C_{18}$, mean chain length $C_{15.5}$).

V3: 12.5 parts by weight ethoxylated fatty alcohol V1, 12.5 parts by weight ethoxylated fatty alcohol V2.

The laundering experiments were performed in the Launderometer with ten steel balls added in each instance. The laundering temperature was 60° C., the addition rate 10 g/l, the water hardness 16° dH, the weight ratio of textile to laundering bath 1:12, and the washing duration 30 minutes. After laundering, rinsing with tap water was performed three times for 15 seconds each. The textiles presented in Table 1, soiled under standardized conditions, were used in the experiments:

TABLE 1

| Designation | Textile material | Soil |
|---|---|---|
| T1 | cotton | tea |
| T2 | cotton | milk, carbon black |
| T3 | cotton | blood, milk, India ink |
| T4 | special finish cotton | carbon black, kaolin, iron oxide, sebum |
| T5 | polyester | carbon black, kaolin, iron oxide, sebum |

The results were evaluated photometrically. The reflectances presented in Table 2 below represent mean values of five individual determinations in each case.

In most cases the results reveal a distinct superiority of the detergent composition of the invention compared to the reference samples, especially with regard to the laundering ability toward soils consisting of tea and protein materials.

TABLE 2

| | % Reflectance | | | | |
|---|---|---|---|---|---|
| Laundering agent | T1 | T2 | T3 | T4 | T5 |
| Example 1 | 41.0 | 53.0 | 40.0 | 39.8 | 38.8 |
| V1 | 38.9 | 47.0 | 38.6 | 39.0 | 38.6 |
| V2 | 39.7 | 47.5 | 39.0 | 39.4 | 38.0 |
| V3 | 39.9 | 47.4 | 38.8 | 39.8 | 38.2 |

EXAMPLES 2–6

The composition of the detergent compositions in wt. % used in these examples is given in Table 3 below.

The abbreviations used in the table have the following meanings:

PO: propylene oxide groups,
EO: ethylene oxide groups,
$FA_1$: fatty alcohol group as in EXAMPLE 1,
$FA_2$: fatty alcohol group consisting of 80% oleyl alcohol, remainder cetyl alcohol,
$FA_3$: fatty alcohol group consisting of 50% oleyl alcohol, 1% lauryl alcohol, 9% myristyl alcohol, 30% cetyl alcohol and 10% stearyl alcohol,
TAF: tallow fatty acid,
COF: coconut fatty acid,
HPF: hydrogenated palm kernel fatty acid,
TEA: triethanolamine,
ATMP: aminotrimethylene phosphonate (Na salt),
EDTMP: ethylenediaminetetramethylene phosphonate (Na salt).

The storage behavior, enzyme stabilities and laundering capabilities of these detergent compositions gave the same results as the composition of EXAMPLE 1 within the limits of error.

TABLE 3

| Component | Example 2 | 3 | 4 | 5 | 6 |
|---|---|---|---|---|---|
| $FA_1$ + 1.2 PO + 6.3 EO | 16 | 12 | — | — | — |
| $FA_1$ + 2 PO + 14 EO | 8 | 6 | — | — | — |
| $FA_1$ + 1.5 PO + 10 EO | — | 6 | — | — | — |
| $FA_2$ + 1.5 PO + 6 EO | — | — | 16 | 18 | — |
| $FA_2$ + 2 PO + 13 EO | — | — | 8 | 12 | — |
| $FA_3$ + 1.5 PO + 7 EO | — | — | — | — | 17 |
| $FA_3$ + 2 PO + 16 EO | — | — | — | — | 8 |
| TAF | 10 | 12 | — | 8 | — |
| COF | 3 | 5 | 3 | 2 | 4 |
| HPF | — | — | 10 | — | 8 |
| NaOH | 1.2 | 1.3 | 1.3 | 1.2 | 1.2 |
| TEA | 5 | 6 | 5 | 5 | 5 |
| enzyme of Example 1 | 0.8 | 0.8 | 0.8 | 0.8 | 0.8 |
| lactic acid | 0.06 | 0.06 | — | — | 0.05 |
| citric acid | — | 1.0 | 1.0 | 1.0 | 0.5 |
| ATMP | — | — | 0.5 | — | 1.0 |
| EDTMP | — | — | — | 0.5 | — |
| optical brightener of Example 1 | 0.06 | 0.06 | 0.06 | 0.06 | 0.1 |
| ethanol | 10 | 10 | 10 | 10 | 10 |
| propylene glycol | 5 | 5 | 5 | 5 | 5 |
| water | remainder | remainder | remainder | remainder | remainder |
| pH | | | 7.9 to 8.5 | | |

What is claimed is:

1. A homogeneous aqueous liquid laundering and cleaning detergent composition, essentially free from inorganic builder salt consisting essentially of:

(a) from about 20 to about 40 wt. % of a mixture of nonionic surfactants of the formula:

$$RO-[CH_2-CH(CH_3)-O]_m-(CH_2-CH_2-O)_n-H \quad (I)$$

wherein R is a $C_{10}$–$C_{20}$ aliphatic hydrocarbon group which is linear or methylated in the 2-position and can be saturated or unsaturated, or R represents a mixture of such groups; m is a number from 1 to 5; n is a number from 3 to 20; n>m; and wherein the mixture of nonionic surfactants is composed of the following components:

(i) from about 5 to about 9 parts by weight of at least one compound of the above Formula I wherein n=3 to 9,
(ii) from about 1 to about 5 parts by weight of at least one compound of the above Formula I wherein n=10 to 20, and
(iii) from 0 to about 6 parts by weight of a compound of the above Formula I wherein m=1 to 3 and n=9 to 11;

(b) from about 2 to about 25 wt. % based on fatty acid of at least one sodium, potassium monoalkanolamine, dialkanolamine or trialkanolamine soap of a $C_{10}$–$C_{20}$ saturated or monounsaturated fatty acid;
(c) from about 0.001 to about 2 wt. % of at least one proteolytic enzyme; and
(d) from about 5 to about 25 wt. % of at least one monohydroxy or polyhydroxy alcohol having 2 to 4 carbon atoms;

wherein (a) and (b) taken together constitute from about 30 to about 50 wt. % of the detergent composition, and wherein a 1% aqueous solution of the detergent composition has a pH value in the range of from about 6.5 to about 9.

2. A detergent composition in accordance with claim 1 wherein (a) and (b) taken together constitute from about 35 to about 45 wt. % of the detergent composition.

3. A detergent composition in accordance with claim 1 wherein there is present in (a) from about 6 to about 8 parts by weight of component (i) wherein m=1 to 3, and n=4 to 8; and from about 2 to about 4 parts by weight of component (ii) wherein m=1 to 4, and n=12 to 16.

4. A detergent composition in accordance with claim 1 wherein in (a) the R group in Formula I is a mixture of groups which are from 25 to 100 wt. % monounsaturated and from 0 to 75 wt. % saturated, and which contain from 12 to 18 carbon atoms.

5. A detergent composition in accordance with claim 1 wherein (b) is from about 5 to about 20 wt. % of a sodium or triethanolamine soap of fatty acids which comprise from about 40 to 100 wt. % oleyl groups and from 0 to about 60 wt. % saturated linear fatty acids having from 12 to 18 carbon atoms.

6. A detergent composition in accordance with claim 1 wherein (d) is a mixture of 1,2-propylene glycol, and at least one of ethanol and isopropanol, wherein the weight ratio of monohydroxy alcohol to 1,2-propylene glycol is from about 5:1 to about 1:5.

7. A detergent composition in accordance with claim 1 wherein from about 0.5 to about 10 wt. % of free alkanolamine is also present therein.

8. A detergent composition in accordance with claim 1 wherein from about 0.1 to about 3 wt. %, based on free acid, of at least one water-soluble salt of a polycarboxylic acid or of a polyphosphonic acid is also present therein.

9. A detergent composition in accordance with claim 8 wherein the water-soluble salt of a polycarboxylic acid is a water-soluble salt of citric acid, and is present in from about 0.5 to about 3 wt. %.

10. A detergent composition in accordance with claim 8 wherein the water-soluble salt of a polyphosphonic acid is a water-soluble salt of an aminoalkane polyphosphonic acid.

* * * * *